US006367643B2

(12) United States Patent
Ranze et al.

(10) Patent No.: US 6,367,643 B2
(45) Date of Patent: Apr. 9, 2002

(54) CRYOSTAT, CRYOSTAT POSITIONING METHOD AND CRYOSTAT ALIGNMENT SET

(75) Inventors: Richard Andrew Ranze, Scotia; Kenneth Gordon Herd, Niskayuna, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/566,492

(22) Filed: May 8, 2000

Related U.S. Application Data

(62) Division of application No. 09/240,512, filed on Jan. 29, 1999, now Pat. No. 6,185,808.

(51) Int. Cl.[7] ..... B65D 1/40; F25B 19/00

(52) U.S. Cl. ..... 220/23.89; 220/560.1; 220/918; 220/919; 62/51.1; 62/45.1

(58) Field of Search ..... 174/15.6; 335/301; 411/107; 29/455.1, 428; 220/560.04, 23.89, 918, 560.12, 560.14, 912, 919, 23.9, 23.91, 23.87, 560.1, 901; 62/50.7, 51.1, 45.1

(56) References Cited

U.S. PATENT DOCUMENTS

| | | | | | |
|---|---|---|---|---|---|
| 3,240,377 | A | * | 3/1966 | Dixon | 29/446 |
| 3,245,571 | A | * | 4/1966 | Canty et al. | 29/446 |
| 4,318,056 | A | * | 3/1982 | Sze | 372/57 |
| 4,492,090 | A | * | 1/1985 | Laskaris | 62/50.7 |
| 4,837,541 | A | * | 6/1989 | Pelc | 335/301 |
| 5,722,146 | A | * | 3/1998 | Seigle et al. | 29/446 |

* cited by examiner

*Primary Examiner*—S. Thomas Hughes
*Assistant Examiner*—Marc Jimenez
(74) *Attorney, Agent, or Firm*—Lester R Hale; Donald S. Ingraham

(57) ABSTRACT

A cryostatic vessel 12 is radially interconnected inside a tubular thermal shield 18. A shield first endplate 20 includes a plurality of spacers 30 which are disposed in axial abutment with a corresponding first endplate 14 of the vessel during assembly. A shield second endplate 22 is disposed in axial abutment against an opposite end of the shield, and includes alignment holes 36 receiving corresponding alignment pins 32 extending from an opposite endplate 16 of the vessel. The spacers maintain a predetermined clearance between the endplates of the vessel and shield which clearance is precisely maintained upon fixedly joining both shield endplates to the shield.

5 Claims, 6 Drawing Sheets

Fig. 3
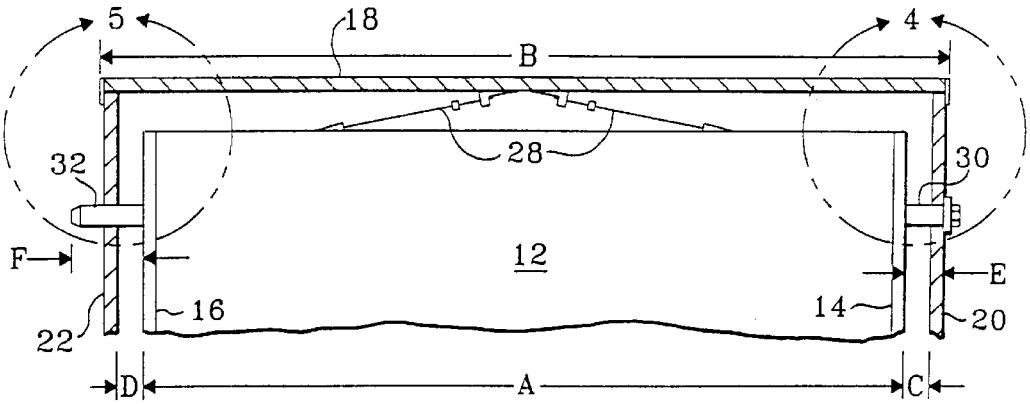
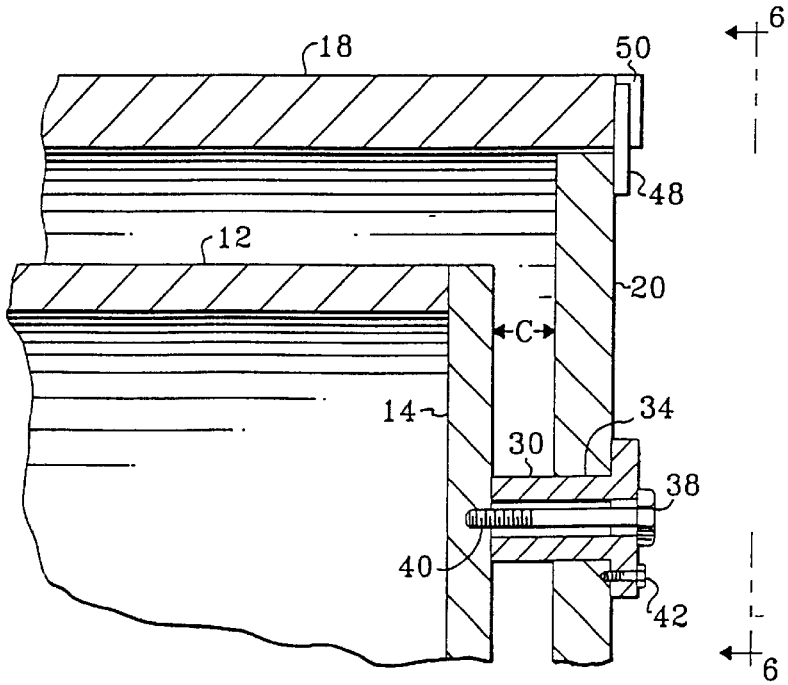
Fig. 4

CRYOSTAT, CRYOSTAT POSITIONING METHOD AND CRYOSTAT ALIGNMENT SET

This application is a division of application Ser. No. 09/240,512, filed Jan. 29, 1999 now U.S. Pat. No. 6,185,808 Issued on Feb, 13, 2001, which is hereby incorporated by reference in its entirety.

BACKGROUND OF THE INVENTION

The present invention relates generally to magnetic resonance imaging (MRI) scanners, and, more specifically, to cryostats therein.

An MRI scanner includes a superconducting electrical coil for generating a strong magnetic field for diagnostic imaging of a target by magnetic resonance thereof. The coil is disposed inside a cryostatic vessel which includes liquid helium for achieving the cryogenic operating temperatures required for maximizing performance of the superconducting coil.

Maintaining superconducting low temperature of the coil requires suitable thermal insulation which is provided in part by surrounding the cryostatic vessel with a thermally insulating shield. The shield, in turn, is disposed inside a vacuum vessel for providing additional thermal insulation.

For maximizing performance of the MRI scanner, the cryostatic vessel must be precisely aligned both radially and axially inside the surrounding thermal shield. And, this must be accomplished with minimal interconnections therebetween to prevent undesirable thermal short circuits which would degrade the thermal isolation of the cryostatic vessel.

The cryostatic vessel is in the form of a tubular outer shell having integral endplates at axially opposite ends thereof. The endplates include center apertures joined to a tubular inner shell extending through the vessel defining its bore. The vessel is suitably sealed for containing therein the superconducting coil and the liquid helium.

The vessel is typically radially suspended concentrically inside the thermal shield by a plurality of radial suspensions or mounts at the axially opposite ends. The thermal shield is typically a cylindrical shell initially open at both axially opposite ends thereof during the manufacturing process for permitting nesting of the vessel and shield and installation of the radial mounts. Each radial mount typically includes a threaded fastener, such as a bolt, which is adjustable for adjusting the radial position of the vessel inside the shield. Four radial mounts are typically provided at each end of the vessel in diametrically opposite pairs along the vertical and horizontal centerlines thereof. By adjusting the bolts, corresponding lengths of the radial mounts are adjusted for permitting concentric alignment of the vessel inside the shield at both axial ends.

Axial suspensions or mounts are also provided between the vessel and shield typically at the middle thereof on diametrically opposite sides. The axial mounts extend axially with a radial inclination between the outer surface of the vessel and the inner surface of the shell, and also include threaded fasteners, such as bolts, for adjusting length and tension therein. The axial mounts are typically arranged in pairs extending in opposite axial directions so that the mounts may be adjusted individually to precisely control the axial position of the vessel inside the thermal shield.

The thermal shield is enclosed at its axially opposite ends by a corresponding pair of endplates, each having a central aperture through which a tubular inner shell is later mounted for completing the thermal shield to fully surround the cryostat vessel.

The cryostatic vessel must not only be precisely centered radially within the thermal shield, but also axially therein with equal gaps or clearances between the corresponding endplates of the vessel and shield. Accurate axial positioning of the vessel inside the shield is typically accomplished by providing a plurality of access holes in each of the shield endplates through which a measuring ruler may be inserted for measuring the clearance between the endplates. Four access holes are typically provided in each shield endplate in diametrically opposite pairs at the vertical and horizontal centerlines. Precise axial clearance between the corresponding endplates is required at each of the four circumferentially spaced apart access holes at each end of the vessel.

The axial clearances are adjusted by adjusting the corresponding lengths of the axial mounts. However, the axial alignment process is difficult and time consuming since it is basically a random process which is conducted iteratively. When any one axial clearance at the corresponding access hole is too small or too large, adjustment of the several axial mounts not only affects the out of specification axial clearance being addressed, but other axial clearances as well. This has been the assembly process for one type of conventional cryostat used in commercial service for over a year.

Furthermore, adjustment of the axial mounts may also affect radial alignment since the vessel is suspended inside the shield by both the radial and axial mounts. In addition to axial adjustment of the position of the vessel inside the shield, further adjustment of the radial position may also be required. Once these adjustments are made within a suitable tolerance, the shield endplates may then be permanently affixed to the outer shell thereof, typically by providing a plurality of circumferential tack welds around the perimeter of each of the shield endplates and the adjoining portions of the shield outer shell.

Accordingly, it is desired to provide an improved cryostat apparatus and assembly for reducing alignment time and increasing accuracy of alignment.

BRIEF SUMMARY OF THE INVENTION

A cryostatic vessel is radially interconnected inside a tubular thermal shield. A shield first endplate includes a plurality of spacers which are disposed in axial abutment with a corresponding first endplate of the vessel during assembly. A shield second endplate is disposed in axial abutment against an opposite end of the shield, and includes alignment holes receiving corresponding alignment pins extending from an opposite endplate of the vessel. The spacers maintain a predetermined clearance between the endplates of the vessel and shield which clearance is precisely maintained upon fixedly joining both shield endplates to the shield.

BRIEF DESCRIPTION OF THE DRAWINGS

FIG. 3 is a partly sectional, elevational side view of the cryostat illustrated in FIG. 1 and taken along line 3—3.

FIG. 4 is an enlarged elevational sectional view through one end of the cryostat illustrated in FIG. 3 within the dashed circle labeled 4.

DETAILED DESCRIPTION OF THE INVENTION

Figure 1:
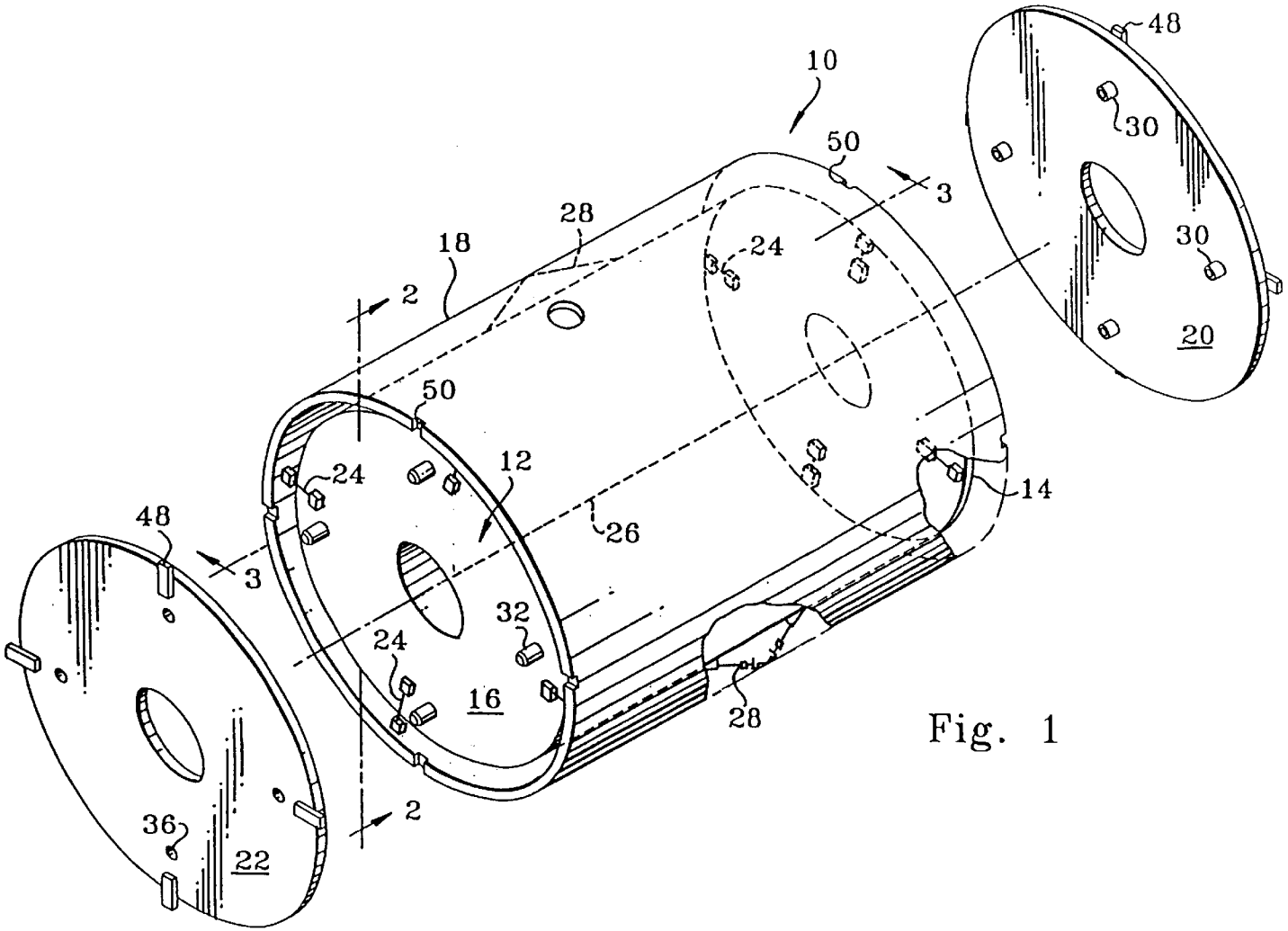
FIG. 1 is a schematic, partly exploded isometric view of a cryostat for an MRI scanner in accordance with an exemplary embodiment of the present invention.

Illustrated schematically in FIG. 1 is the major portion of a cryostat 10 configured for use in an MRI scanner for diagnostic imaging of a target by nuclear magnetic resonance. The cryostat 10 includes a cryostatic vessel 12 in which is disposed a superconducting magnetic coil maintained at cryogenic temperatures by liquid helium therein (not shown).

The vessel 12 is tubular with radially spaced apart, cylindrical outer and inner shells which are closed at axially opposite ends thereof by corresponding first and second endplates or flanges 14,16 in the form of flat circular disks with central apertures. The endplates are joined at their outer perimeters to the vessel outer shell, with the central apertures thereof being joined to the inner shell to define an enclosed pressure vessel.

A tubular thermal shield 18 surrounds the vessel 12 which is nested preferably concentrically therein. The thermal shield 18 is in the form of a tubular shell to which are fixedly joined first and second endplates or flanges 20,22 at corresponding axially opposite ends thereof. The vessel 12 and shield 18 are preferably formed of aluminum, with the shield 18 also including an internal layer of thermal insulation (not shown) in the clearance or gap between the outer surface of the vessel including its endplates, and the inner surface of the shield including its endplates.

Figure 2:
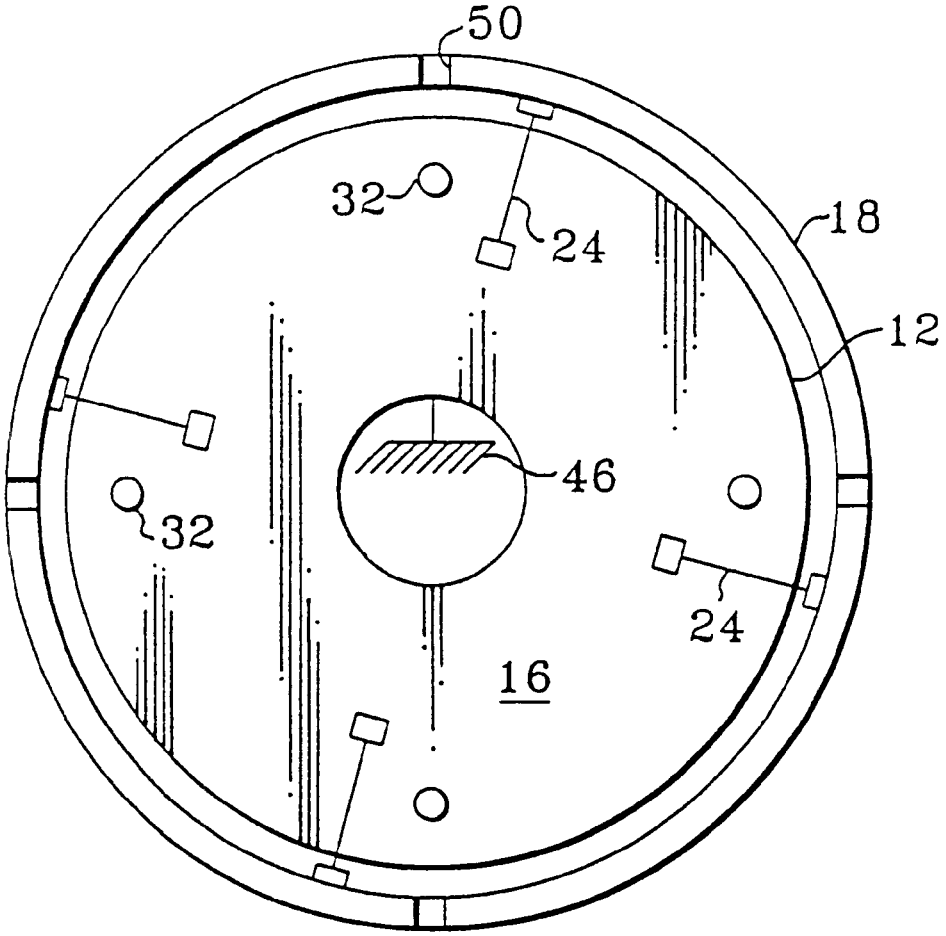
FIG. 2 is a vertical end view of the cryostat illustrated in FIG. 1 and taken along line 2—2.

As shown in FIGS. 1 and 2, a plurality of circumferentially spaced apart radial suspensions or mounts 24 are fixedly joined between the corresponding vessel endplates 14,16 and the radially inner surface of the shield 18 for suspending the vessel inside the shield after final assembly. The radial mounts 24 may have any conventional form including end blocks joined together by radially extending tension straps, with an adjustable fastener or bolt between the strap and the radially outer block for permitting radial adjustment of the length of the radial mount to correspondingly adjust the radial position of the vessel inside the shield.

The shield 18 is cylindrical with an axial or longitudinal centerline axis 26 as shown in FIG. 1, and the radial mounts 24 are adjustable in length for radially centering the vessel 12 concentrically inside the shield 18 as additionally shown in FIG. 2. In a preferred embodiment, four radial mounts 24 are provided at each end of the vessel 12 and are equiangularly spaced apart from each other circumferentially around the vessel 12 in diametrically opposite pairs near the vertical and horizontal centerlines of the vessel.

As initially shown in FIG. 1, and in more detail in FIG. 3, a plurality of axial suspensions or mounts 28 are fixedly connected between the outer surface of vessel 12 and the inner surface of the shield 18 near the middle thereof in the available radial space therebetween. The axial mounts 28 may have any conventional form, with each having, for example, opposite end blocks fixedly mounted to the vessel and shield with a tension strap extending therebetween having a fastener or bolt at the outboard end of the strap which is adjustable for adjusting the length of the axial mount and the tension therein.

In the exemplary embodiment illustrated in FIGS. 1 and 3, the axial mounts are disposed in pairs extending in axially opposite directions from the middle of the shield and inclined radially toward the vessel inboard thereof. The axial mounts 28 are arranged in pairs on diametrically opposite sides of the vessel such as at the vertical centerline thereof. As shown in FIG. 3, adjusting the length of the axial mounts 28 adjusts the axial position of the vessel 12 relative to the shield 18.

The cryostat 10 as above described is conventional in configuration, including configuration of both the radial mounts 24 and the axial mounts 28 and the radial and axial adjustment capability thereof. As indicated in the background section, the shield endplates 20,22 are installed in the end openings of the shield 18, and axial, as well as radial, adjustments of the vessel inside the shield was conventionally accomplished by manual measurement of axial end clearances, with adjustment of the mounts as required for obtaining radial and axial centering.

In accordance with the present invention, the configuration of the cryostat 10 is modified for effecting an improved method of positioning the vessel 12 in the thermal shield 18.

More specifically, a plurality of circumferentially spaced apart plug gauges or spacers 30 are disposed between the vessel first endplate 14 and shield first endplate 20 as shown in FIGS. 1 and 3, and more specifically in FIG. 4. Correspondingly, the vessel second endplate 16 includes a plurality of circumferentially spaced apart alignment plugs or pins 32 extending axially outwardly therefrom as illustrated in FIGS. 1–3, and more specifically in FIG. 5.

As shown in enlarged view in FIG. 4, the shield first endplate 20 includes a plurality of first alignment or access holes 34 extending axially therethrough for receiving respective ones of the spacers 30 extending in part therethrough. As shown in enlarged view in FIG. 5, the shield second endplate 22 includes a plurality of circumferentially spaced apart second alignment or access holes 36 for receiving respective ones of the pins 32 axially therethrough.

Figure 6:
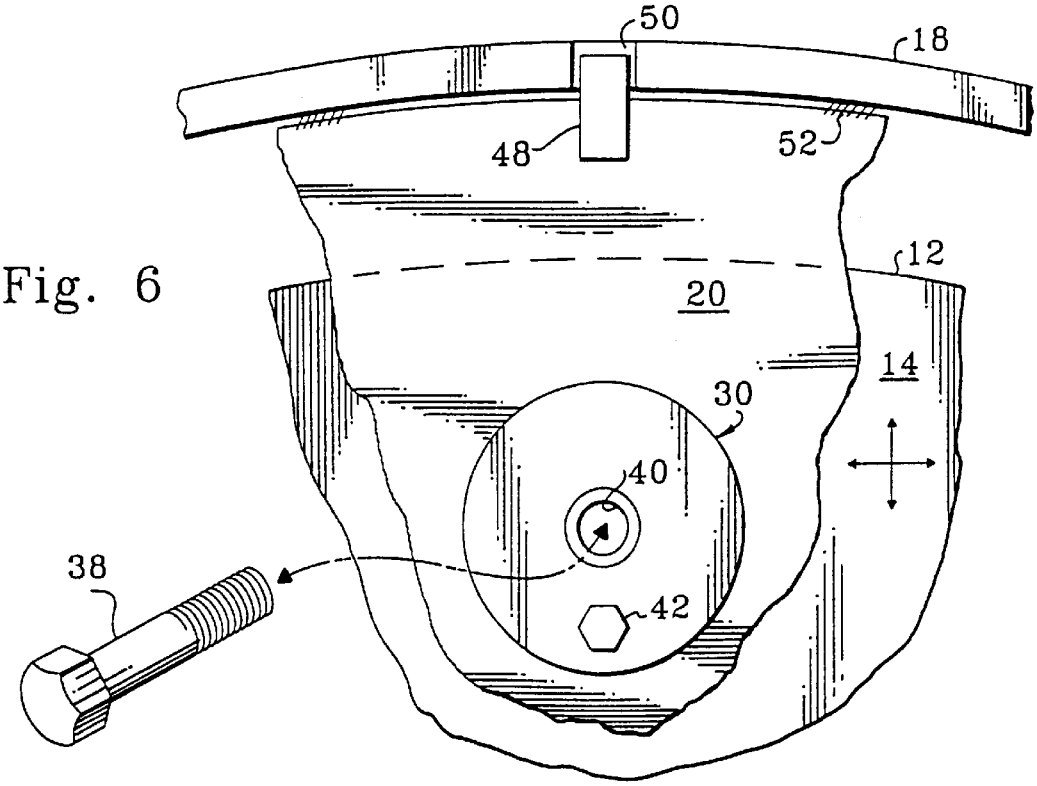
FIG. 6 is an end view of the shield endplate and an exemplary spacer illustrated in FIG. 4 and taken along line 6—6.

As initially shown in FIGS. 4 and 6, each of the spacers 30 is preferably tubular for receiving therethrough a retention fastener or bolt 38. The bolt 38 has an enlarged head disposed on the outboard side of the shield first endplate 20, and is threaded at its opposite inboard end for threadingly engaging a blind first threaded hole 40 formed in the vessel first endplate 14. As shown in FIG. 4, the spacer 30 is sized in diameter and length for assembly through the corresponding first access hole 34 to axially abut the vessel first endplate 14. The spacer 30 has an enlarged head with a greater diameter than its body or shank, which is also larger in diameter than the first access hole 34 for abutting the outboard side of the shield first endplate 20.

In the preferred embodiment illustrated in FIGS. 4 and 6, the spacer head also includes an offset aperture therethrough through which extends another fastener or screw 42 for temporarily fixedly securing the corresponding spacer 30 tightly against the shield first endplate 20.

Figure 5:
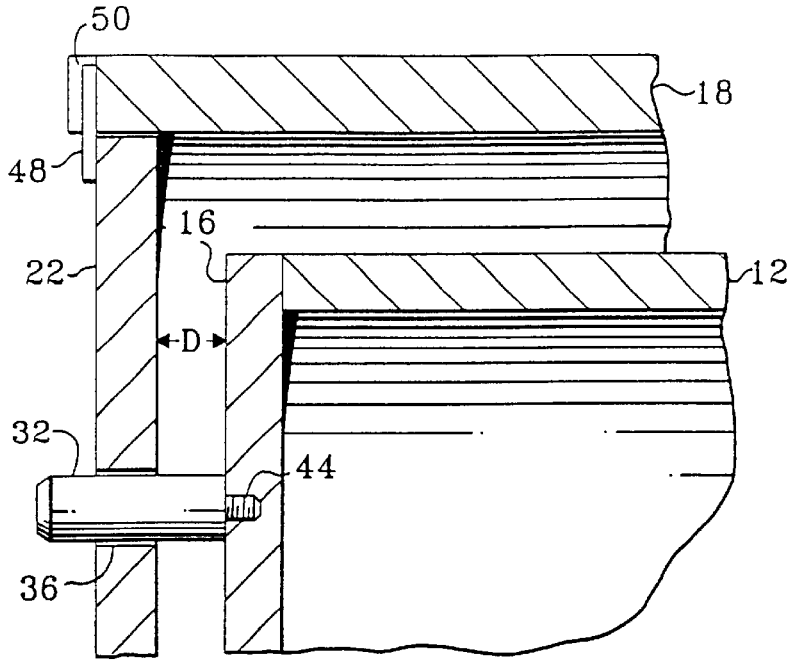
FIG. 5 is an enlarged elevational sectional view of an opposite end of the cryostat illustrated in FIG. 3 within the dashed circle labeled 5.

As shown in FIG. 5, each alignment pin 32 is preferably cylindrical and has an integral threaded stud extending axially therefrom for threadingly engaging a corresponding blind second threaded hole 44 in the vessel second endplate 16 for temporarily securing the pins to the vessel. Each of the pins 32 is sized in length beginning at its junction with the stud to extend through the corresponding second access holes 36 of the shield second endplate 22 during assembly.

Figure 7:
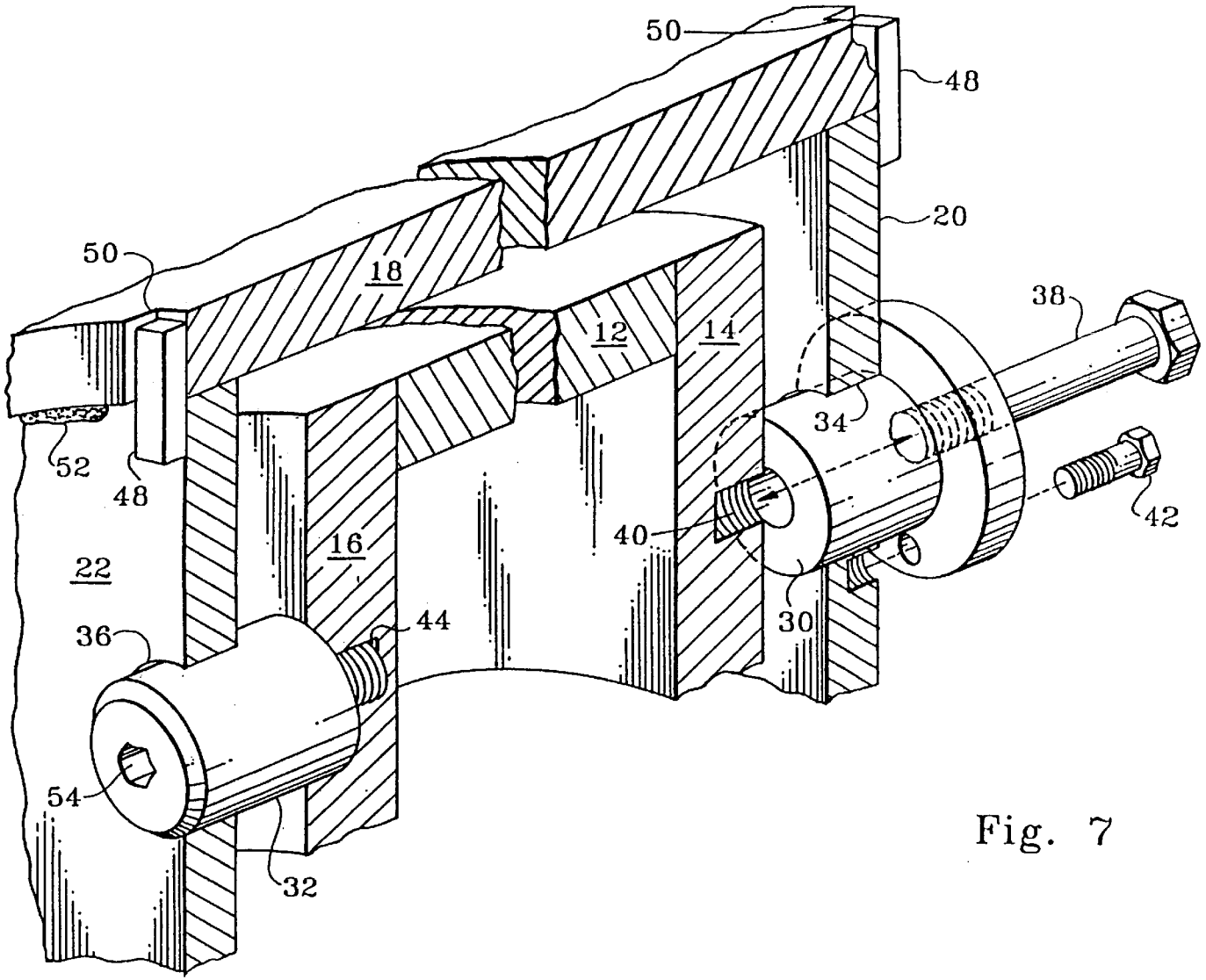
FIG. 7 is a partly sectional isometric view of a representative pair of endplate spacers and alignment pins corresponding to the those illustrated within the two dashed circles labeled 4 and 5 in FIG. 3.

A corresponding pair of the alignment spacer 30 and pin 32 are illustrated in more detail in FIG. 7 installed through the corresponding shield endplates 20,22. The spacer and pin define an alignment set for use in positioning and aligning the cryostatic vessel 12 inside the thermal shield 18 during assembly.

As shown in FIG. 1, the alignment set preferably includes four of the spacers 30 equiangularly spaced apart in the shield first endplate 20, with four of the alignment pins 32 being similarly equiangularly spaced apart from each other in the vessel second endplate 16. This preferred set of four spacers and four pins allows retrofit for a conventional cryostat configuration. In an alternate embodiment, three of the spacers 30 may be used and spaced apart from each other at 120 ∘, with similarly spaced apart three of the pins 32 for effective centering of the vessel 12 within the thermal shield 18.

Figure 8:
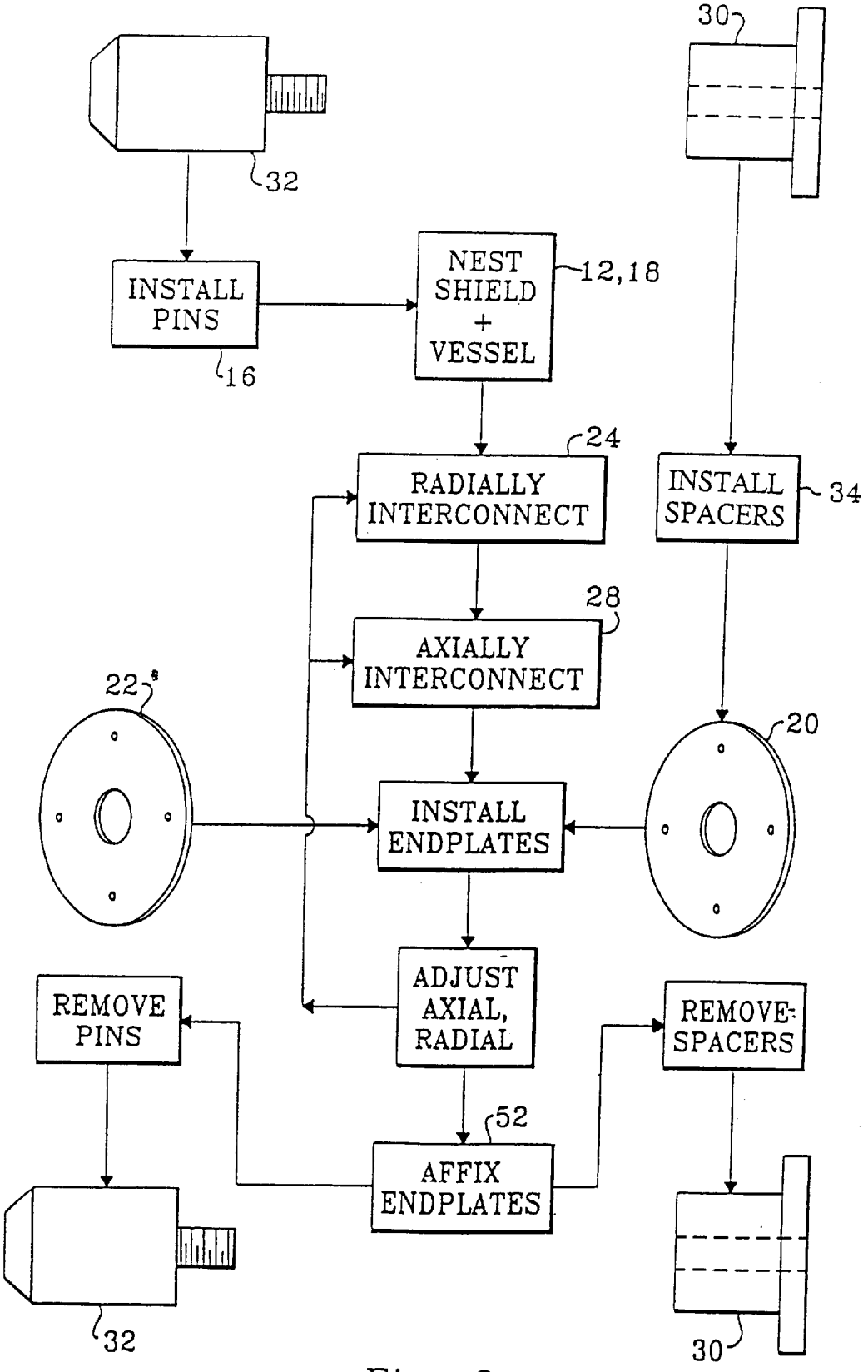
FIG. 8 is a flowchart representation of an exemplary method of positioning the cryostatic vessel illustrated in FIGS. 1–7 inside the tubular thermal shield.

FIG. 8 is a flowchart representation of an improved method for positioning or aligning the cryostatic vessel 12 inside the thermal shield 18 illustrated in FIG. 1 for example. The assembly method commences with the conventional nesting together of the vessel 12 inside the thermal shield 18. This is typically accomplished by using a boom hoist 46, shown schematically in FIG. 2, which supports the preassembled cryostatic vessel 12 above the assembly floor. The tubular shield 18 is axially positioned around the supported vessel 12.

The several alignment pins 32 may be threadingly installed in their corresponding second threaded holes 44 in the vessel second endplate 16 at any convenient time prior to assembly of the shield second endplate 22. Correspondingly, the several spacers 30 may be installed through the corresponding first access holes 34 in the shield first endplate 20 at any convenient time preferably prior to assembly of the shield first endplate 20 to the thermal shield 18.

It is noted that the first and second access holes 34,36 illustrated in FIG. 7, for example, and the first and second threaded holes 40,44 are conventionally found in an existing cryostat configuration in commercial use for more than one year. As indicated in the Background section, the access holes were previously used for inserting therethrough measuring rulers for manually measuring the clearance between the corresponding endplates. The threaded holes 40,44 were used for receiving retention bolts like the retention bolts 38 for temporarily fixing the shield endplates 20,22 to the vessel 12 prior to welding those endplates to the adjoining shield 18.

These existing features are used to advantage by incorporating therewith the specifically configured spacers 30 and alignment pins 32 for improving the alignment process in accordance with the present invention.

After the shield and vessel are initially nested together, the vessel is radially suspended or interconnected at a plurality of circumferentially spaced apart locations defined by the respective radial mounts 24 illustrated in FIGS. 1 and 2. In the exemplary embodiment illustrated, four radial mounts 24 are provided at each of the two axially opposite vessel endplates 14,16 for radially supporting the cylindrical vessel inside the cylindrical shield.

The vessel 12 is also axially suspended or interconnected inside the shield 18 at a plurality of circumferentially spaced apart locations defined by the several axial mounts 28 illustrated in FIGS. 1 and 3. The axial mounts 28 are initially loosely installed for subsequent tightening to fix the axial position of the vessel inside the shield. Initial installation of the radial and axial mounts 24,28 is conventional.

In accordance with the present invention, the shield first endplate 20 as initially shown in FIG. 1 is installed in axial abutment against the first open end of the cylindrical shield 18, with the preinstalled spacers 30 being disposed in axial abutment with the vessel first endplate 14 as illustrated in FIG. 3. This may be accomplished by using a plurality of circumferentially spaced apart tabs 48 fixedly joined to the outboard face of the shield first endplate 20 as illustrated in FIG. 4.

The tabs 48 are sized in thickness for being received in corresponding radial slots 50 formed in the axially exposed end of the shield 18. The outer diameter of the shield first endplate 20 is slightly smaller than the inner diameter of the shield 18 for permitting its insertion therein until the tabs 48 engage the slots 50 preventing further axial inboard movement. The slots 50 have a preferred axial depth to axially offset the outboard face of the endplate 20 into the end of the shield 18 for providing a small comer in which subsequent welding may be made.

As shown in FIG. 5, additional tabs 48 are also fixedly joined to the perimeter of the shield second endplate 22 for being received in corresponding radial slots 50 in that end of the shield 18 in a manner identical to that of the first endplate 20. This feature of both endplates 20,22 is also conventional.

After the first endplate 20 with the attached spacers 30 is assembled to one end of the shield 18 as initially shown in FIG. 1, the shield second endplate 22 is installed in axial abutment against the corresponding end of the shield, again using the cooperating tabs 48 and slots 50. The second access holes 36 receive corresponding ones of the alignment pins 32 which extend axially outwardly from the vessel second endplate 16. The initial assembly of the two endplates 20,22 to the shield 18 for enclosing the vessel 12 therebetween is illustrated in FIG. 3.

The use of the spacers 30 permits automatic axial positioning or centering of the vessel 12 inside the shield 18, after which the shield first and second endplates 20,22 may be suitably fixedly joined to the axially opposite ends of the cylindrical shield 18 itself. This may be accomplished by using conventional tack welds 52 in the weld comers or seats defined at the perimeters of the endplates within the shield 18 as illustrated in more detail in FIGS. 6 and 7.

FIGS. 3 illustrates the various dimensions used for axially centering the vessel 12 inside the shield 18. The vessel 12 has a precise axial length A from end-to-end which is suitably smaller than the axial length B between the opposite axial ends of the cylindrical shield 18. Axial centering of the vessel 12 inside the shield 18 requires an axial gap or clearance C between the shield first endplate 20 and the opposing vessel first endplate 14 which is substantially equal to the axial gap or clearance D between the shield second endplate 22 and the opposing vessel second endplate 16. The axial end clearances C,D are preferably equal to each other at each of the four spacers 30 and at each of the four alignment pins 32.

Automatic axial positional control of the vessel 12 inside the shield 18 is effected by sizing the length E of the individual spacers 30 between their heads and distal ends for projecting the spacer distal heads inboard from the inner surface of the shield first endplate 20 a distance equal to the desired axial clearance C.

The pins 32 have a length F which is suitably long to bridge the expected second axial clearance D and the thickness of the shield second endplate 22, with a suitable axial projection therefrom.

Accordingly, when the shield first endplate 20 is assembled in axial abutment against the thermal shield 18, the four spacers 30 correspondingly abut the vessel first endplate 14 at four corresponding locations. The axial mounts 28 may be adjusted to ensure that all four spacers 30 abut the corresponding first endplate 14.

The retention bolts 38 are installed through the corresponding spacers 30 to fixedly clamp together the shield and vessel endplates 20,14 for maintaining the precise first axial clearance C therebetween. In this way, the precise axial clearance may be obtained during subsequent tack welding of the endplates to the shield 18.

The alignment pins 32 at the axially opposite end of the vessel 12 permit the shield second endplate 22 to be slid thereover into position in abutment against the corresponding end of the shield 18. Since the vessel and shield are axially symmetrical, with the corresponding endplates 20,22 having preferably equal thicknesses and identically mounted using the corresponding tabs 48 in slots 50, the length E of the spacers 30 may be readily selected for ensuring that the second axial clearance D is substantially the same as the first axial clearance C for centering the vessel 12 between the two endplates 20,22.

It is noted that the first axial clearance C is directly controlled by the length E of the spacers 30 and is subject to a small tolerance of a few mils. The second axial clearance D is controlled by the dimensional accuracy of the shield first endplate 20, the length B of the shield 18, and the dimensional accuracy of the shield second endplate 22, with a corresponding stack-up of the respective tolerances thereof. Accordingly, the tolerance on the second axial clearance D is greater than the tolerance on the first axial clearance C but is nevertheless suitably small for ensuring precise centering of the vessel 12 between the two endplates 20,22.

Once all four spacers 30 axially abut the vessel first endplate 14, both shield endplates 20,22 may be initially tack welded to the corresponding ends of the shield 18. The axial mounts 28 may then be finally adjusted through corresponding access holes provided through the shield 18 by tightening the several adjustment bolts therein. By placing the corresponding straps of the axial mounts 28 in tension, the axial position of the vessel 12 inside the shield 18 may be maintained. Tension in the axial mounts 28 may be conventionally controlled by using suitable torque on the corresponding fasteners thereof. The finally adjusted axial mounts 28 are therefore effective for maintaining the desired axial position of the vessel 12 axially centered inside the shield 18.

In an exemplary embodiment, the vessel 12 and shield 18 are axially interconnected by the axial mounts 28 prior to fixedly joining the shield endplates 20,22 to the shield 18 by tack welding.

The several spacers 30 and alignment pins 32 may then be removed from the respective shield first and second endplates 20,22 after the axial mounts 28 are finally adjusted, and tack welding of the two endplates 20,22 to the shield 18 is completed.

As shown in FIG. 7, the individual spacers 30 may be removed from their corresponding first access holes 34 by simply reversing the installation process by removing the retention bolts 38 and screws 42.

Correspondingly, the individual alignment pins 32 may be removed from the vessel second endplate 16 through the second access holes 36 by inserting a suitable removal tool in a corresponding end slot 54 in the exposed ends of the pins 32. The spacers and pins are therefore readily removed from outside the thermal shield and its endplates for maintaining the thermal isolation between the cryostatic vessel 12 and its thermal shield.

An additional advantage of the spacers 30 and alignment pins 32 is the ability for precisely adjusting radial position of the vessel 12 inside the shield 18 at both axial ends thereof. In FIG. 6 before the retention bolts 38 are installed, the center bore of the spacers 30 may be used for sighting the corresponding first threaded holes 40. Radial alignment of the vessel 12 including its endplates, concentrically within the cylindrical shield 18 requires radial alignment of the first threaded holes 40 and the spacers 30. The radial mounts 24 may be suitably adjusted to precisely effect the required radial alignment therebetween. The retention bolts 38 may then be installed for clamping the endplates 20,14 together.

Correspondingly, the alignment pins 32 shown in FIG. 7 must be suitably aligned with the second access holes 36 in the shield second endplate 22 for assembly, and, the second endplate 22 must concentrically fit within the open end of the cylindrical shield 18 during assembly. Any radial misalignment between the second endplate 22 and the shield 18 may be adjusted by adjusting the corresponding radial mounts 24.

Radial adjustment of the radial mounts 24 is improved by positioning the spacers 30 and pins 32 circumferentially adjacent corresponding ones of the radial mounts as shown in FIGS. 1 and 2. In this way, adjustment of each radial mount correspondingly repositions the vessel endplates 14,16 along the radius of the corresponding radial mounts.

The alignment spacers 30 and pins 32 provide simple and accurate assembly of the shield endplates to automatically self center the vessel 12 axially therebetween. The speed of the assembly process is substantially increased. And, the pins and spacers may be readily removed to maintain thermal isolation between the vessel and shield.

The remainder of the assembly process may then be conducted in any conventional manner. An inner shell of the shield is assembled through the center apertures of the endplates 20,22 and sealed thereto. A surrounding vacuum vessel then encloses the nested cryostatic vessel and shield for providing additional thermal insulation.

While there have been described herein what are considered to be exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

What is claimed is:

1. A cryostat comprising:

a cryostatic vessel having first and second endplates at axially opposite ends thereof, said second endplate having a plurality of temporary alignment pins extending therefrom;

a tubular thermal shield surrounding said vessel, and having first and second endplates at axially opposite ends thereof, said shield second endplate having a plurality of alignment holes receiving respective ones of said pins;

a plurality of radial mounts suspending said vessel inside said shield at both ends thereof;

a plurality of axial mounts interconnecting said vessel inside said shield; and a plurality of circumferentially spaced apart temporary spacers disposed between said vessel first endplate and said shield first endplate; wherein said temporary spacers and said temporary alignment pins are adapted to be removed from said shield first endplate and said vessel second endplate, respectively after said axial mounts are finally adjusted, and said shield first endplate and said shield second endplate are fixedly joined to said shield.

2. A cryostat according to claim 1 wherein said shield first endplate includes a plurality of alignment holes each receiving a respective one of said spacers extending therethrough.

3. A cryostat according to claim 2 wherein said spacers are tubular, and each includes a retention bolt extending therethrough in threaded engagement with said vessel first endplate.

4. A cryostat according to claim 3 wherein each of said spacers further includes a head at an outboard end disposed on an outboard side of said shield first endplate, and an opposite inboard end disposed in abutting contact with said vessel first endplate.

5. A cryostat according to claim 2 wherein said pins threadingly engage said vessel second endplate.

* * * * *